US009458579B2

(12) United States Patent
Ishimaru

(10) Patent No.: US 9,458,579 B2
(45) Date of Patent: Oct. 4, 2016

(54) ARTIFICIAL TURF AND ARTIFICIAL TURF FACILITY

(75) Inventor: Takeshi Ishimaru, Kobe (JP)

(73) Assignee: SUMITOMO RUBBER INDUSTRIES, LTD., Kobe-Shi (JP)

( * ) Notice: Subject to any disclaimer, the term of this patent is extended or adjusted under 35 U.S.C. 154(b) by 299 days.

(21) Appl. No.: 14/124,609

(22) PCT Filed: May 30, 2012

(86) PCT No.: PCT/JP2012/003533
§ 371 (c)(1),
(2), (4) Date: Dec. 6, 2013

(87) PCT Pub. No.: WO2013/046494
PCT Pub. Date: Apr. 4, 2013

(65) Prior Publication Data

US 2014/0093663 A1 Apr. 3, 2014

(30) Foreign Application Priority Data

Sep. 30, 2011 (JP) ..... 2011-216587

(51) Int. Cl.
*E01C 13/08* (2006.01)
*D06N 7/00* (2006.01)

(52) U.S. Cl.
CPC ..... *E01C 13/08* (2013.01); *D06N 7/0065* (2013.01); *D06N 2201/0245* (2013.01); *D06N 2201/0254* (2013.01); *D06N 2209/141* (2013.01); *Y10T 428/23957* (2015.04); *Y10T 428/23993* (2015.04)

(58) Field of Classification Search
CPC ..... D06N 7/0065; D06N 7/0068; D06N 2201/0245; D06N 2201/0254; D06N 2209/141; D02G 3/445; D02G 3/444; D05C 17/026
USPC ..... 428/97, 92, 17
See application file for complete search history.

(56) References Cited

U.S. PATENT DOCUMENTS 4,347,203 A * 8/1982 Mimura ..... D01D 5/247 264/172.14
4,442,173 A * 4/1984 Takegami ..... D01F 6/18 264/182
4,562,114 A * 12/1985 Sawanishi ..... D01F 6/38 428/372
4,810,449 A * 3/1989 Reinehr ..... D01F 6/54 264/182

(Continued)

FOREIGN PATENT DOCUMENTS

GB WO 2005003461 A1 * 1/2005 ..... E01B 35/12
JP 6-33412 A 2/1994
JP 2000-27113 A 1/2000

OTHER PUBLICATIONS

Machine translation of JP 06-033412 A, Kitamura et al., 1994.*

(Continued)

*Primary Examiner* — Cheryl Juska
(74) *Attorney, Agent, or Firm* — Birch, Stewart, Kolasch & Birch, LLP

(57) ABSTRACT

Provided are artificial turf with which a temperature alleviation effect can be sustained over an extended period and which is easily maintained, and an artificial turf facility wherein the artificial turf is laid. A first pile (41), and a second pile (42) which comprises a water absorbent void therein which absorbs water, which configure the artificial turf, are placed mixed among each other in a base fabric (31) at a prescribed proportion.

4 Claims, 1 Drawing Sheet

(56) References Cited

U.S. PATENT DOCUMENTS

| | | | | |
|---|---|---|---|---|
| 7,097,904 | B2 * | 8/2006 | Ochi | D01D 5/247 428/370 |
| 2005/0260911 | A1 * | 11/2005 | Ochi | D01D 5/247 442/189 |

OTHER PUBLICATIONS

International Search Report, issued in PCT/JP2012/003533, dated Sep. 4, 2012.

* cited by examiner

ARTIFICIAL TURF AND ARTIFICIAL TURF FACILITY

TECHNICAL FIELD

The present invention relates to artificial turf laid, for example, in a soccer field and the like, more specifically to artificial turf which suppresses an increase in temperature of the artificial turf to reduce a load on a player.

BACKGROUND ART

Artificial turf having a longer turf length than ordinary one, so-called long pile artificial turf, has spread through various athletic sports facilities, such as a soccer field, a rugby field, and a baseball field, as an artificial turf surface having the characteristics close to natural turf by filling the space between the piles with a filler.

As a filler for this type of artificial turf, for example, an elastic granular material of a rubber chip (a crushed article of a waste tire or industrial rubber such as EPDM) or a thermoplastic elastomer (such as a PE-based elastic resin) is preferably used.

Incidentally, since a rubber chip prepared using a waste tire itself is colored in black with carbon, it easily absorbs sunlight, and the surface temperature of the artificial turf may become 60° C. or more under blazing heat in summer or the like. As a result, exercise on the artificial turf in summer may impose a large load to a player, impairing comfort. Further, in some cases, the artificial turf cannot be used over a long period of time since the surface temperature is kept high by a filler which has absorbed heat even after sunset.

Therefore, for example, in the invention described in Patent Literature 1, titanium oxide having light-reflecting properties is added to a filler to thereby reflect light to suppress an increase in temperature of the surface of artificial turf, by which a certain temperature increase-suppressing effect is obtained compared with the case where a black rubber chip is used; however, it is hard to say that the increase in temperature can be sufficiently suppressed.

Therefore, as a method of further enhancing a cooling effect, for example, Patent Literatures 2 and 3 disclose a method of suppressing an increase in temperature by evaporation heat, in which a part of a primary backing of artificial turf and a filler is allowed to contain a water-absorbing resin, which is sprinkled with water to store water therein.

However, this method requires time for maintenance because the surface of the artificial turf has to be periodically sprinkled with water, and since a problem may occur in the properties of artificial turf itself without an accurate control of the amount of the water-absorbing resin and the amount of water sprinkled, management of the state will take further labor.

As a method of solving these problems, for example, Patent Literature 4 discloses a technique in which the inner part of turf yarn (pile) is formed into a hollow straw shape; the pile is implanted in a primary backing in a U-shape so that both open ends may farm the tips of the pile (refer to FIG. 4 of Patent Literature 4); and further the pile on the primary backing side is broken so that the water stored on the bottom of the artificial turf can be emitted from the tip side of the pile to the surface of the artificial turf by the capillary action.

According to the technique, the artificial turf is trampled to allow the water to leak out from the turf tip, thereby capable of suppressing an increase in temperature over a long period of time. However, the method described in Patent Literature 4 has been designed as a surface for artificial turf skiing areas in summer and intends to always keep the surface of the artificial turf in a wet state, in order to protect a fallen person from an abraded wound and to improve the sliding of the ski.

Therefore, when the artificial turf of Patent Literature 4 is applied to a surface for general athletic fields such as a soccer field and a baseball field, it will be slippery and may, conversely, largely impair the playability since the surface of the artificial turf is wet. Further, since all of the turf yarns are constituted by straw-shaped piles in this artificial turf, it has been difficult to improve the characteristics as a surface for sports in spite of good temperature suppression effect.

CITATION LIST

Patent Literature

Patent Literature 1: Japanese Patent Application publication No. 2010-59659

Patent Literature 2: Japanese Patent Application publication No. H06-33411

Patent Literature 3: Japanese Patent Application publication No. 2007-126850

Patent Literature 4: Japanese Patent Application publication No. 2000-27113

DISCLOSURE OF THE INVENTION

Technical Problem

Thus, the present invention has been made to solve the problems as described above, and an object of the present invention is to provide artificial turf which can sustain temperature suppression effect over a long period of time and is also easy in maintenance, and to provide artificial turf facilities prepared by laying the artificial turf.

Solution to Problem

In order to achieve an object as described above, the present invention has several features to be shown below. In accordance with claim 1 of the present invention, artificial turf comprises a primary backing and piles implanted in the primary backing, the piles comprising at least a first pile and a second pile, wherein the second pile has a hydrophilized void in the inner part thereof, and the first pile and the second pile are mixed implanted in the primary backing in a predetermined proportion.

In accordance with claim 2 of the present invention, the second pile is implanted so that B/(A+B)=10 to 30% by volume is satisfied, wherein A represents the amount of the first pile implanted and B represents the amount of the second pile implanted, in the artificial turf according to claim 1.

In accordance with claim 3 of the present invention, the first pile is made of polypropylene or polyethylene, and the second pile is made of an acrylic hydrophilic resin, in the artificial turf according to claim 1 or 2.

In accordance with claim 4 of the present invention, the space between the piles is further filled with a filler, in the artificial turf according to any one of claims 1 to 3.

The present invention further includes artificial turf facilities prepared by laying the artificial turf according to any one of claims 1 to 4. Examples of the artificial turf facilities in which the artificial turf is used may include sports facilities such as a soccer field, a baseball field, and an athletic field, as well as various outdoor facilities and indoor facilities. Furthermore, the artificial turf may be used in a park, a promenade, and the like, and the artificial turf facilities include all the facilities that can lay the artificial turf of the present invention.

Advantageous Effects of Invention

In accordance with claim 1 of the present invention, the artificial turf individually comprises a first pile which determines the properties of artificial turf and a second pile only for temperature suppression which contains water and utilizes the evaporation heat. Thus, the temperature suppression effect can be enhanced without changing the characteristics of artificial turf itself.

In accordance with claim 2 of the present invention, the amount of the second pile implanted is in the range of 10 to 30% by volume. Thus, the temperature suppression effect can be enhanced without changing the characteristics of artificial turf itself.

In accordance with claim 3 of the present invention, the first pile is made of polypropylene or polyethylene, and the second pile is made of acrylics. Thus, the first pile can maintain a proper rigid feeling and cushioning properties required for artificial turf, and the second pile can have hydrophilicity suitable for storing water.

In accordance with claim 4 of the present invention, the space between the piles is further filled with a filler. Thus, the properties closer to natural turf can be reproduced.

BEST MODE FOR CARRYING OUT THE INVENTION

Next, embodiments of the present invention will be described referring to drawings, but the present invention is not limited to these drawings.

Figure 1:
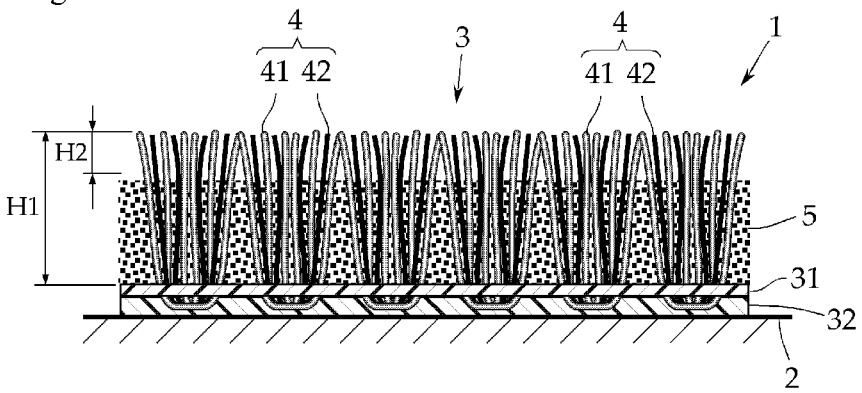
FIG. 1 is a sectional view showing a major portion of an artificial turf structure in which artificial turf according to one embodiment of the present invention is laid.

As shown in FIG. 1, this artificial turf structure 1 has artificial turf 3 laid on a base 2, and the space between piles 4 of the artificial turf 3 is filled with a granular or a stringy filler 5. The base 2 may be, for example, a low cost road pavement surface in which a ground surface is evenly leveled or an existing pavement surface paved with asphalt or the like.

Further, an elastic pavement or the like may be provided on the base 2, or the base 2 may include an embodiment in which an old existing artificial turf is left standing, and the artificial turf structure 1 is newly laid on the old one. In the present invention, the structure of the base 2 can be changed depending on specification and is an arbitrary matter.

The artificial turf 3 comprises a primary backing 31 and piles 4 implanted therein in a predetermined spacing. The primary backing 31 comprises a plain weave cloth made of a synthetic resin such as polypropylene and polyethylene and has a mass of 100 to 200 g/m$^2$.

A thermoplastic resin is used for the primary backing 31 in this embodiment, but low density polyethylene (LDPE) having good meltability is preferred in consideration of recyclability. Further, the primary backing may be formed by implanting a cotton-like material of a synthetic resin in a plain weave cloth by punching.

Note that, although the color of the primary backing 31 is arbitrarily determined depending on specification, the primary backing is preferably colored in a color other than black so that it hardly absorbs sunlight, for example, when it is recycled as a filler for artificial turf.

The pile 4 is preferably a so-called long pile having a pile length H1 from the surface of the primary backing 31 to the tip thereof of as long as from 40 to 75 mm. In the present invention, the pile 4 includes a first pile 41 and a second pile 42 having water absorption properties.

A material for the pile 4 is preferably selected from a thermoplastic resin such as polypropylene and polyethylene, but low density polyethylene (LDPE) having good meltability is more preferred in consideration of recyclability, as in the case of the primary backing 31. The pile 4 is generally colored green in order to bring it close to the color of natural turf, but it may be colored in any color other than a color which easily absorbs light.

A bundle of a plurality of monotape yarns or monofilament yarns, or a band of split yarn may be used for the first pile 41. As an example, the first pile 41 has a thickness of 8000 dtex and is implanted in the primary backing 31 in an implant amount of 1000 g/m$^3$.

Figure 2:
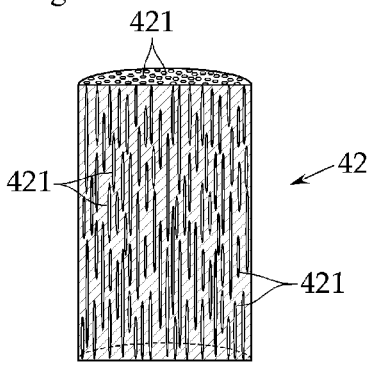
FIG. 2 is a sectional view schematically showing a major portion of a structure of the second pile of the present invention.

Next, with reference also to FIG. 2, the second pile 42 is made of fibers of an acrylic hydrophilic resin in this embodiment, and a large number of hydrophilized microvoids 421 are provided in the inner part of the fibers. The microvoid 421 includes extremely fine open-cells which are formed thinly elongated along the elongation direction of a fiber and have an average pore size of, for example, 10 nm so that water may be raised by capillary action from the root side on the primary backing 31 side to the tip side.

As an example of the acrylic hydrophilic resin fiber having the microvoid 421 in the inner part thereof, for example, a high-performance water-absorbing acrylic fiber "product number: K909" manufactured by Toyobo Co., Ltd. is suitably used. In this embodiment, the specification of the second pile 42 includes a thickness of 0.9 to 2.4 dtex, a water capacity of 5 to 6 g/g, a strength of 2.8 to 3.3 CN/dtex, and an elongation percentage of 40 to 50%.

The second pile 42 is preferably implanted so that B/(A+B)=10 to 30% by volume is satisfied, wherein A represents the amount of the first pile 41 implanted and B represents the amount of the second pile 42 implanted.

According to the above, when the second pile 42 occupies 10 to 30% of the whole volume of the pile 4, it is possible to obtain artificial turf 3 having a well balance between exercise functionality and temperature suppression effect.

That is, if the amount of the second pile implanted is less than 10% by volume, the amount of water supplied will be too small, which is not preferred since the temperature suppression effect by evaporation heat may be small. Conversely, if it exceeds 30%, the proportion of the second pile 42 whose durability is lower than the first pile 41 may be too high, which is not preferred since the use feeling and appearance as artificial turf may be poor, leading to a problem as a product.

The piles 4 are implanted in the primary backing 31 in the state where one more first piles 41 and one or more second piles 42 are integrally twisted. When the first pile 41 and the second pile 42 are implanted in the primary backing 31 in the state where they are integrally twisted, a single tufting step to artificial turf is enough, thus capable of suppressing production cost.

Figure 3:
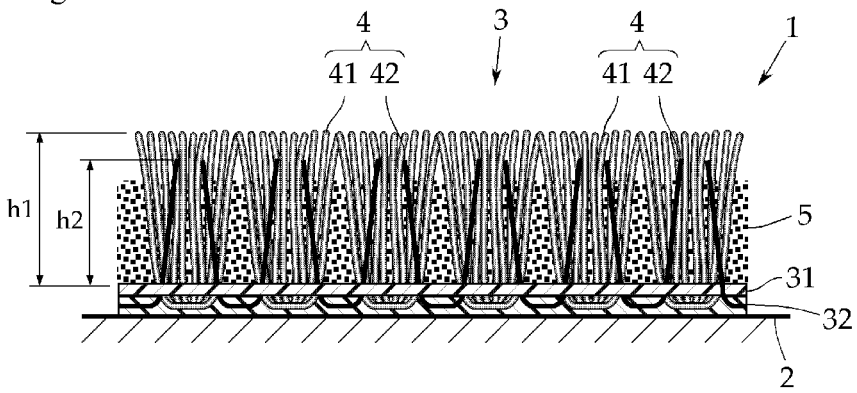
FIG. 3 is a sectional view showing a major portion of an artificial turf structure in which artificial turf is laid in which the first pile and the second pile are individually implanted.

Alternatively, as shown in FIG. 3, one or more first piles 41 and one or more second piles 42 may be implanted in the primary backing 31 in the state where they are independently implanted.

According to this embodiment, when the first pile 41 and the second pile 42 are implanted in the primary backing 31 in the state where they are independently implanted, the pile length h1 of the first pile 41 and the pile length h2 of the second pile 42 can be individually set. Furthermore, since the spacing of the implanted piles can also be freely changed, the artificial turf 3 can be designed depending on service conditions.

Although the second pile 42 is composed of one monofilament yarn in this embodiment, a bundle of a plurality of monotape yarns or monofilament yarns, or a band of split yarn may be used. The shape of the second pile 42 may be arbitrarily changed depending on specification as long as it has the microvoid 421 in the inner part and has water absorption properties.

Further, in order to prevent the tufted pile 4 from being dropped off, a backing material 32 is uniformly applied to the back of the primary backing 31. Although a thermosetting resin such as SBR latex or urethane is used for the backing material 32, an extender such as calcium carbonate is optionally added thereto.

In this embodiment, the backing material 32 is uniformly applied so that the amount applied is from 600 to 900 g/m$^2$ (after drying). Note that the backing material 32 is preferably colored in a color other than black in consideration of the case where it is recycled, for example, as a filler for artificial turf.

The space between the piles 4 of the artificial turf 3 prepared in this way is filled with a filler 5. In this embodiment, the filler 5 comprises an elastic granular material prepared by crushing a waste tire into small granules and is filled so as to provide a predetermined thickness.

The layer thickness of the filler 5 is arbitrarily selected by the elasticity required, but it is preferably a thickness such that the projection height H2 (length from the surface of the filler layer to the pile tip) of the pile 4 (more specifically, the first pile 41) is 10 to 30 mm or more for preventing the outflow and scattering of the filler 5.

In the present invention, a specific structure, that is, the shape and material, color, particle size, weight, and the like of the filler 5 are arbitrary matters. In this embodiment, the filler 5 is a single layer structure which consists only of an elastic granular material, but a hard granular material such as joint sand may be further added. Furthermore, these fillers may be arranged in a two-layer structure. In addition, a hydrophilic material may be further applied to the surface of the filler 5, or a granular material having water absorption properties may be added to further enhance the moisture holding ability of the whole artificial turf.

EXAMPLES

Next, specific Examples of the present invention will be examined together with Comparative Examples. First, a filler and artificial turf were prepared by the methods below.

(Preparation of Artificial Turf)

Artificial turf samples were prepared by tufting, in a tufting apparatus, a first pile made of low density polyethylene (thickness: 8000 dtex, the amount implanted: 1000 g/m$^2$) and a second pile made of a high-performance water-absorbing acrylic fiber "K909" manufactured by Toyobo Co., Ltd. (thickness: 0.9 dtex, the amount implanted: 100 g/m$^2$) as piles in a primary backing comprising a plain cloth made of polypropylene so that each volume ratio of Example 1 to Example 3 is obtained. In addition, artificial turf which does not have a second pile was prepared as Comparative Example 1, and artificial turf in which the volume ratio of the second pile is 40% was prepared as Comparative Example 2.

[Filling of Filler]

An artificial turf structure was formed by filling each artificial turf sample (20 cm×20 cm) with a rubber chip comprising a waste tire until a layer thickness of 40 mm is obtained. The artificial turf prepared by the method described above was evaluated by the following methods.

[Evaluation of Temperature Suppression Effect]

The surface of each artificial turf as described above was continuously irradiated with light using a light projector, and after the surface maximum temperature reached 75° C., the artificial turf was sprinkled with one liter of water, and the surface temperature was continuously measured. As a result, a sample which was able to maintain a surface temperature of 55° C. or less 3 hours after the water sprinkling was evaluated as ○, and a sample which was unable to maintain the surface temperature was evaluated as X.

[Evaluation of Appearance Properties]

After the evaluation test of temperature suppression effect, each artificial turf sample was visually checked for the falling state of the piles, and a sample which was stable compared with the initial state was evaluated as ○, and a sample in which the piles fell was evaluated as X.

[Evaluation of Playability (Use Feeling)]

In addition, the playability of each artificial turf was evaluated. The evaluation method includes actually running on artificial turf to determine whether a spike is caught more or not by the increase in the amount of the second pile.

Hereinafter, the evaluation results of Examples 1 to 3 and Comparative Example 1 are shown.

Example 1

| [Volume proportion of second pile] 10% | |
|---|---|
| [Temperature suppression effect] | ○ |
| [Appearance properties] | ○ |
| [Playability] | ○ |

Example 2

| [Volume proportion of second pile] 20% | |
|---|---|
| [Temperature suppression effect] | ○ |
| [Appearance properties] | ○ |
| [Playability] | ○ |

Example 1

| [Volume proportion of second pile] 30% | |
|---|---|
| [Temperature suppression effect] | ○ |
| [Appearance properties] | ○ |
| [Playability] | ○ |

Comparative Example 1

| [Volume proportion of second pile] 0% | |
|---|---|
| [Temperature suppression effect] | X |
| [Appearance properties] | ○ |
| [Playability] | ○ |

Comparative Example 2

| [Volume proportion of second pile] 40% | |
|---|---|
| [Temperature suppression effect] | ○ |
| [Appearance properties] | X |
| [Playability] | X |

The results of Examples 1 to 3 and Comparative Examples 1 and 2 are summarized in Table 1.

TABLE 1

| | Proportion of water-absorbing pile | Temperature suppression effect (55 C. or less after 3 hours) | Appearance | Payability (use feeling) |
|---|---|---|---|---|
| Comparative Example1 | 0% | x | ○ | ○ |
| Example 1 | 10% | ○ | ○ | ○ |
| Example 2 | 20% | ○ | ○ | ○ |
| Example 3 | 30% | ○ | ○ | ○ |
| Comparative Example2 | 40% | ○ | x | x |

As described above, the following findings were obtained according to the present invention. Specifically, (1) As shown in Comparative Example 1, the artificial turf which does not contain a second pile cannot provide temperature suppression effect.

(2) As shown in Comparative Example 2, if the volume proportion of a second pile exceeds 40%, the function of the first pile is impaired, and the appearance and playability as artificial turf are lost.

REFERENCE SIGNS LIST

1 Artificial turf structure
2 Base
3 Artificial turf
31 Primary backing
32 Backing material
4 Pile
41 First Pile
42 Second Pile
5 Filler

The invention claimed is:

1. Artificial turf comprising a primary backing and piles implanted in the primary backing, the piles comprising at least a first pile and a second pile, wherein the first pile is made of polypropylene or polyethylene, and the second pile is made of fibers of an acrylic hydrophilic resin having hydrophilized voids in the inner part thereof, said voids including extremely fine open-cells formed to be thin and elongated along the fiber elongation direction with said open-cells having an average pore size of 10 nm; the first and second piles being implanted as a mixture in the primary backing with the second pile implanted so as to satisfy the relationship: B/(A+B)=10 to 30% by volume, wherein A represents the implanted amount of the first pile and B represents the implanted amount of the second pile.

2. The artificial turf according to claim 1, wherein the space between the piles is further filled with a filler.

3. The artificial turf according to claim 1, wherein the primary backing has a mass of 100 to 200 g/m$^2$ and comprises a plain weave cloth made of a synthetic resin of polypropylene or polyethylene.

4. Artificial turf facilities prepared by laying the artificial turf according to claim 1.

* * * * *